US006341618B1

(12) United States Patent
Ricci

(10) Patent No.: US 6,341,618 B1
(45) Date of Patent: Jan. 29, 2002

(54) PLUMBING STOP VALVE AND METHOD OF USE

(76) Inventor: Rudolph V. Ricci, 2001 Marina Dr., Apt. 606, N. Quincy, MA (US) 02171-1543

( * ) Notice: Subject to any disclaimer, the term of this patent is extended or adjusted under 35 U.S.C. 154(b) by 0 days.

(21) Appl. No.: 09/681,743

(22) Filed: May 30, 2001

(51) Int. Cl.[7] ..... E03C 1/288

(52) U.S. Cl. ..... 137/247.23; 137/247.27; 137/269.5; 137/315.08; 137/433; 137/519.5; 68/208

(58) Field of Search ..... 137/247.21, 247.23, 137/247.27, 269.5, 315.08, 315.33, 433, 519.5; 4/681, 682; 68/208

(56) References Cited

U.S. PATENT DOCUMENTS

| | | | | | |
|---|---|---|---|---|---|
| 160,800 | A | * | 3/1875 | Walker | 137/433 |
| 374,008 | A | * | 11/1887 | Schuyler | 137/357 X |
| 844,003 | A | * | 2/1907 | Conrad | 137/247.23 X |
| 903,081 | A | * | 11/1908 | Guthrie et al. | 4/681 X |
| 1,123,705 | A | * | 1/1915 | Dehn | 137/247.23 X |
| 1,318,545 | A | * | 10/1919 | Dehn | 137/247.23 |
| 1,593,083 | A | * | 7/1926 | Kirchhan | 137/247.27 X |
| 1,698,667 | A | * | 1/1929 | Arnold | 137/247.27 |
| 1,725,235 | A | * | 8/1929 | Wellensiek | 137/519.5 X |
| 3,661,167 | A | * | 5/1972 | Hussey | 137/269.5 |
| 3,770,001 | A | * | 11/1973 | Davis | 137/519.5 X |
| 4,296,778 | A | * | 10/1981 | Anderson | 137/433 |
| 5,644,925 | A | * | 7/1997 | Chaves | 62/289 |
| 5,662,138 | A | * | 9/1997 | Wang | 137/433 |
| 5,901,731 | A | * | 5/1999 | Traylor | 137/247.27 X |

* cited by examiner

*Primary Examiner*—John Rivell
(74) *Attorney, Agent, or Firm*—Mark P. White

(57) ABSTRACT

A method for installing plumbing fixtures in a multi-story building having a waste stack includes a stop valve between the waste output of each fixture and the waste stack, the valve allowing the waste water to flow from the fixture toward the waste stack, but preventing flow from the waste stack back into the plumbing fixture. The valve has a cylindrical body, a lower assembly and an upper assembly, which together form a water-tight structure, with threaded outlets in each assembly. Within the body there is suspended a stop ball having a diameter larger than that of the ball seat in the upper outlet. When water attempts to back up from the waste stack in the direction of the stop valve, the ball is forced against the upper seat and blocks the water flow.

14 Claims, 7 Drawing Sheets

PLUMBING STOP VALVE AND METHOD OF USE

BACKGROUND OF INVENTION

1. Field of the Invention

The present invention relates to stop valves attached to sinks and other plumbing fixtures attached to the waste stack, and more specifically, such valves which prevent waste water from backing up into these fixtures.

2. Description Relative to the Prior Art

Most modern plumbing fixtures contain a trap, attached in proximity to the fixture, which prevents gasses, especially sewer gasses, from escaping through the fixture into the atmosphere of the room in which the fixture is located.

Such traps do not, however, prevent liquids under pressure from backing up into the fixture. This is an especial problem in the case of multi-family dwellings, in which the pressure can result from waste water from upper floors which accumulates in a drain or waste stack due to a blockage below. Such a situation is shown in FIG. 1.

Referring now to FIG. 1, the blockage 2, in waste stack 4, will cause water to accumulate up to level 18, which is above the level of sink 10, although not above the level of sinks 6 and 8. The waste stack is the main conduit to conduct waste water from fixtures such as sinks, dishwashers, clothes washers, etc. into the sewer or septic system. Other fixtures, including toilets and urinals, utilize a separate waste stack, and the present invention does not relate to these latter types of fixtures.

Still referring to FIG. 1, the resulting hydrostatic head as a result of the blockage shown will be sufficient to overcome the resistance of P-trap 16, and back up into sink 10, causing it to overflow.

In the case where sinks 6 and 8 are in separate family dwellings within the same house, it may not even be apparent to the residents of the units containing sinks 6 and 8 that a problem exists, as the waste water from these sinks will disappear, but instead of exiting through the sewer pipe in the cellar, the water is all overflowing into the residence containing sink 10.

The present invention remedies this problem by inserting a stop valve between each sink and the waste stack to which it is connected. The stop valve will allow water to flow from the sink toward the waste stack, but will not permit water to flow in the opposite direction. This valve may be likewise used in every plumbing fixture in the house.

SUMMARY OF INVENTION

A general object of the current invention is to provide a means for preventing backup from a waste stack into plumbing fixtures attached to the stack.

In accordance with one aspect of the invention, a method for installing plumbing fixtures, each having a waste water output, in a multi-floor building having a waste stack, includes inserting a stop valve between the waste water output of each fixture and the waste stack. The stop valve allows the waste water to flow from the fixture toward the waste stack, but prevents flow from the waste stack to the waste output of the fixture.

In accordance with a second aspect of the invention, the valve further is made up of a body, a lower assembly having a water outlet, an upper assembly having an upper seat and a water inlet, and a stop ball within the body. The stop ball has a diameter larger than that of the upper seat, and is restrained from descending onto the lower seat in the absence of water flow. As a result when water flows into the outlet, the stop ball is pressed against the upper seat, preventing the water from flowing into the inlet. However, the waste water is allowed to flow freely from the inlet into the outlet.

In accordance with a third aspect of the invention, the fixtures include one or more sinks, and each sink has a sink strainer at the bottom, and has a P-trap is affixed between the sink strainer and the waste stack. Each stop valve is located between a sink strainer and a corresponding P-valve.

According to a fourth aspect of the invention, a dishwasher producing waste water is located in proximity to one or more of the sinks. The waste water of one or more of the dishwashers is conducted to the stop valve below the stop ball restraints, so that the dishwasher waste water cannot back up into the sink.

In accordance with a fifth aspect of the invention, the valve body is substantially cylindrical.

According to a fifth aspect of the invention, the upper assembly and lower assembly are attached to the body by means of ears located on the upper and lower assemblies which mate with slots on the upper and lower portions of the body. An upper O-ring is affixed to the upper assembly, and a lower O-ring affixed to the lower assembly, thus providing a water-tight seal between the upper assembly and the body, and between the lower assembly and the body.

According to a sixth aspect of the invention, the water inlet of the upper assembly and the water outlet of the lower assemblies are threaded.

According to a seventh aspect of the invention, the upper assembly has internal threads, whereas the lower assembly has external threads.

According to an eighth aspect of the invention, the valve body is symmetrical, and the locations of the upper and lower assemblies may be reversed in their position relative to the body.

According to a ninth aspect of the invention, a T-adapter, having an upper end and a lower end, is attached at the upper end to a strainer thread of a sink, and at the lower end to the threads of the upper assembly. The T-adapter serves as a port for the attachment of an exhaust water exhaust hose from the dishwasher.

According to a tenth aspect of the invention, the valve body contains a port located below the stop-ball restraints, into which the exhaust water of a dishwasher may be conducted by the dishwasher exhaust hose. Thus configured, the dishwasher exhaust water cannot back up into the inlet.

According to an eleventh aspect of the invention, three or more restraint arms are integrally formed in the valve body.

According to a final aspect of the invention, the upper and lower assemblies, and the valve body are molded from plastic.

BRIEF DESCRIPTION OF DRAWINGS

These, and further features of the invention, may be better understood with reference to the accompanying specification and drawings depicting the preferred embodiment, in which.

DETAILED DESCRIPTION

Figure 1:
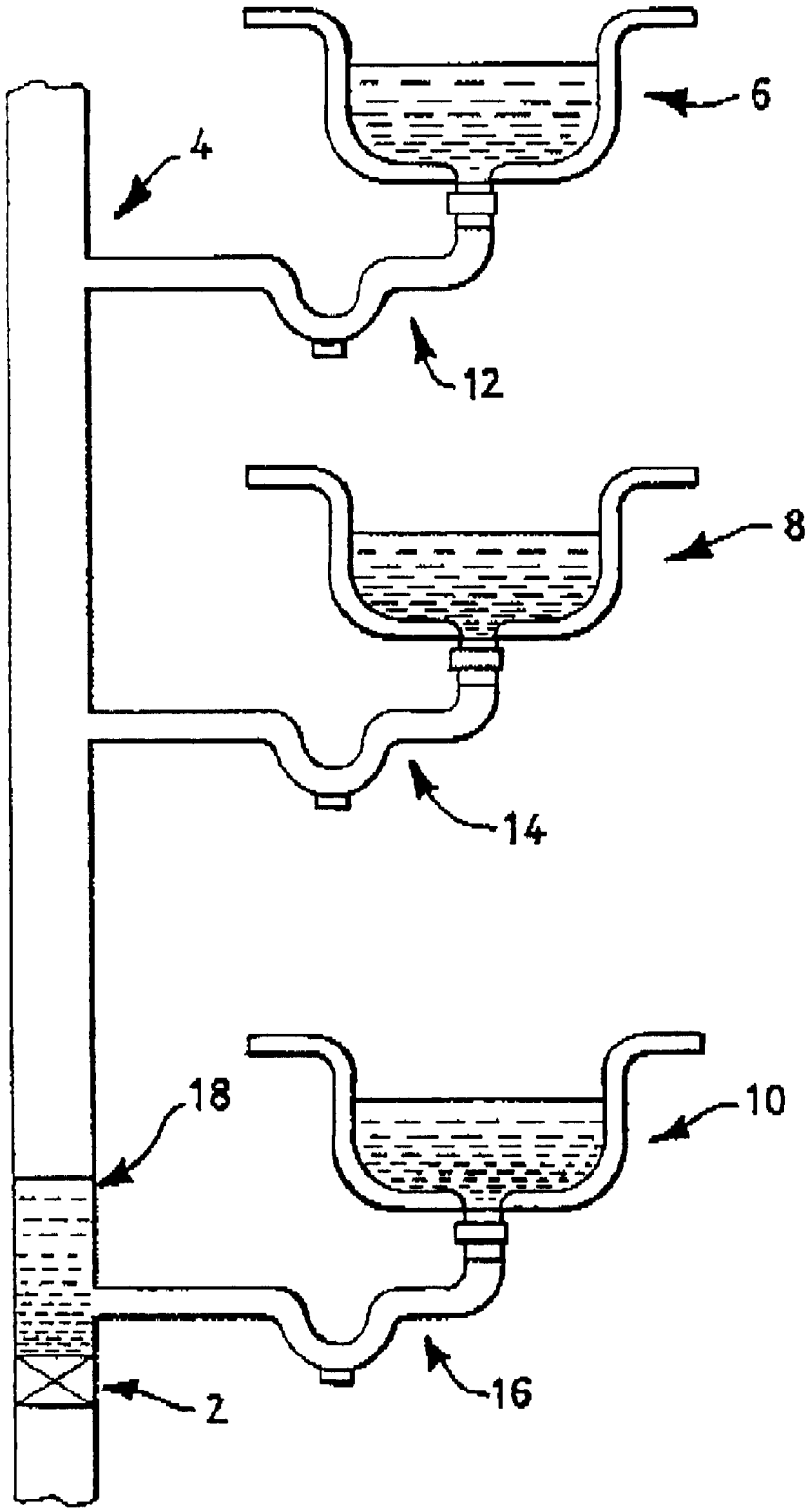
FIG. 1 depicts an elevation view of the prior art, demonstrating a drainage block in a waste stack in a building containing three sinks, each on a different floor.
Figure 3:
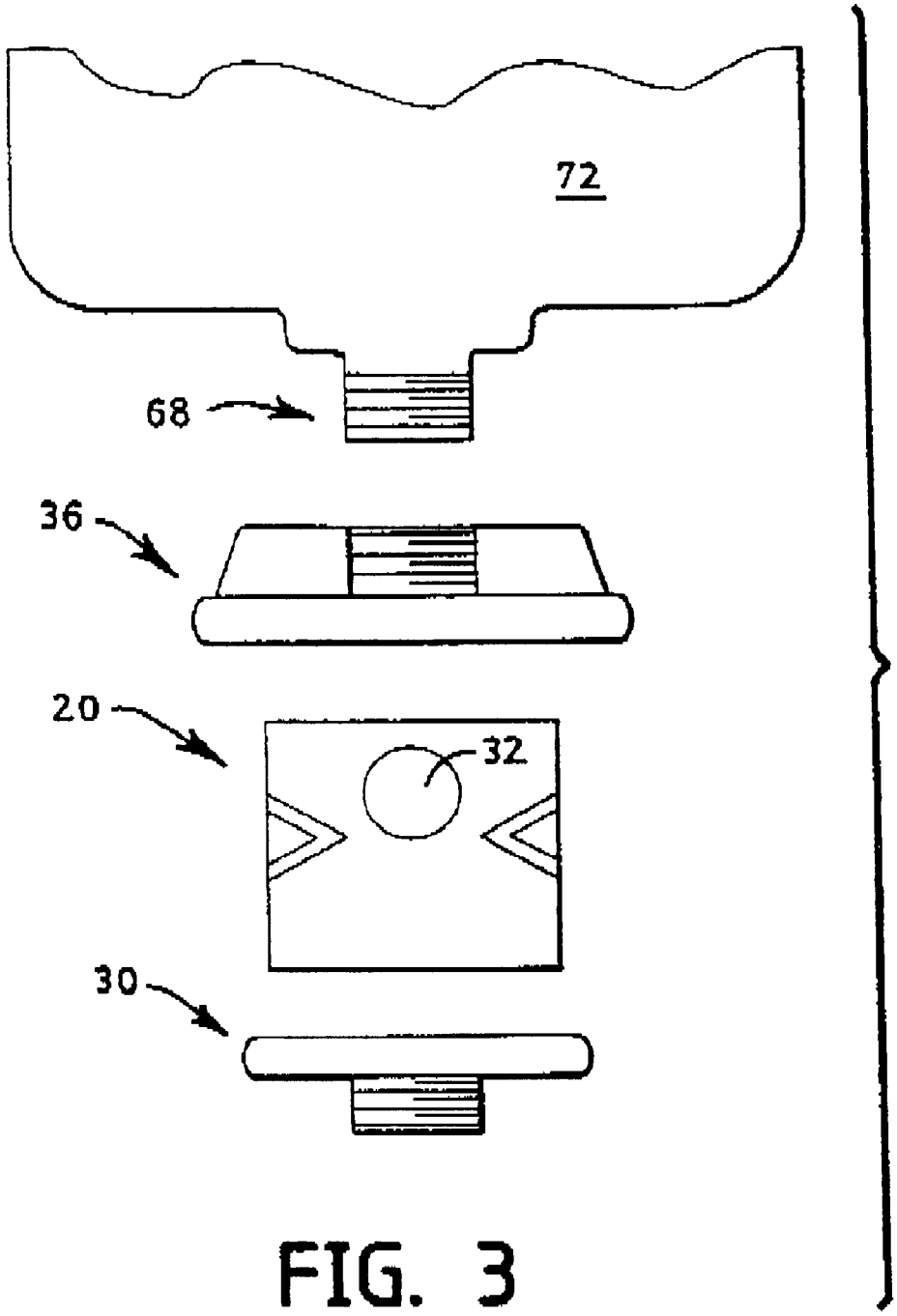
FIG. 3 depicts a side elevation view of the stop valve attached to a sink at one end.

The stop valve itself is primarily intended for use with sinks. Waste water exits through the bottom of a sink through a fitting called a strainer, which is threaded at the bottom. As shown in FIG. 3, the valve is normally attached to the sink strainer 40 at its upper end, and to a tailpiece of the P-trap 73 at the other end. The other end of the P-trap is attached to the waste stack, as shown in FIG. 1.

Figure 2:
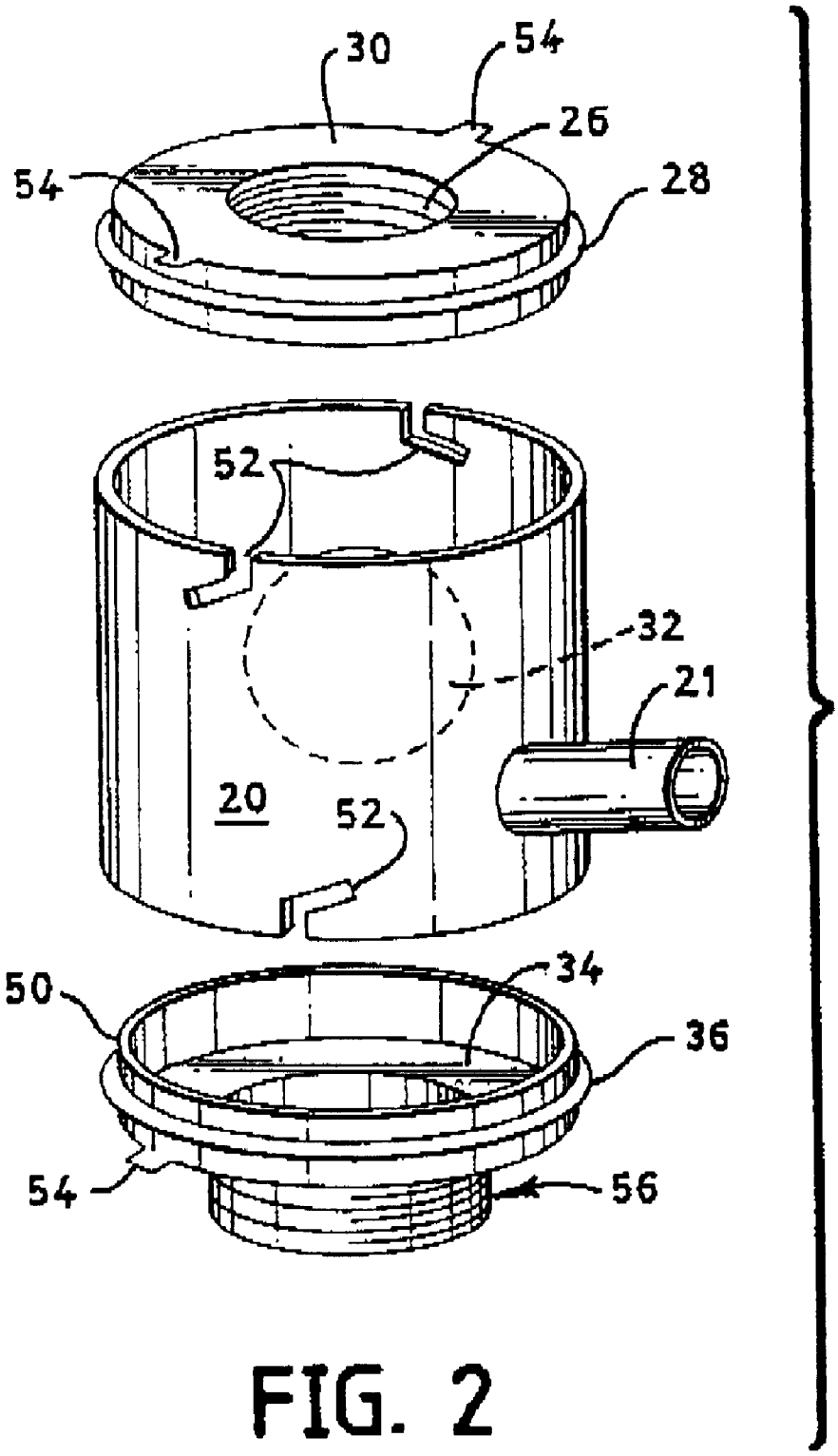
FIG. 2 depicts a perspective view of the stop valve, with top and bottom assembly exploded.

Referring now to FIG. 2, the detail of the valve is shown. The valve has a body 20, generally cylindrical in shape, and open at the bottom. The body mates with a lower assembly 50, by means of ears 54 which insert into slots 52 on the body, and are then rotating, capturing the low part of the body within the lower assembly, with the seal or gasket in the shape of an O-ring 36 creating a water-tight joint.

Figure 7:
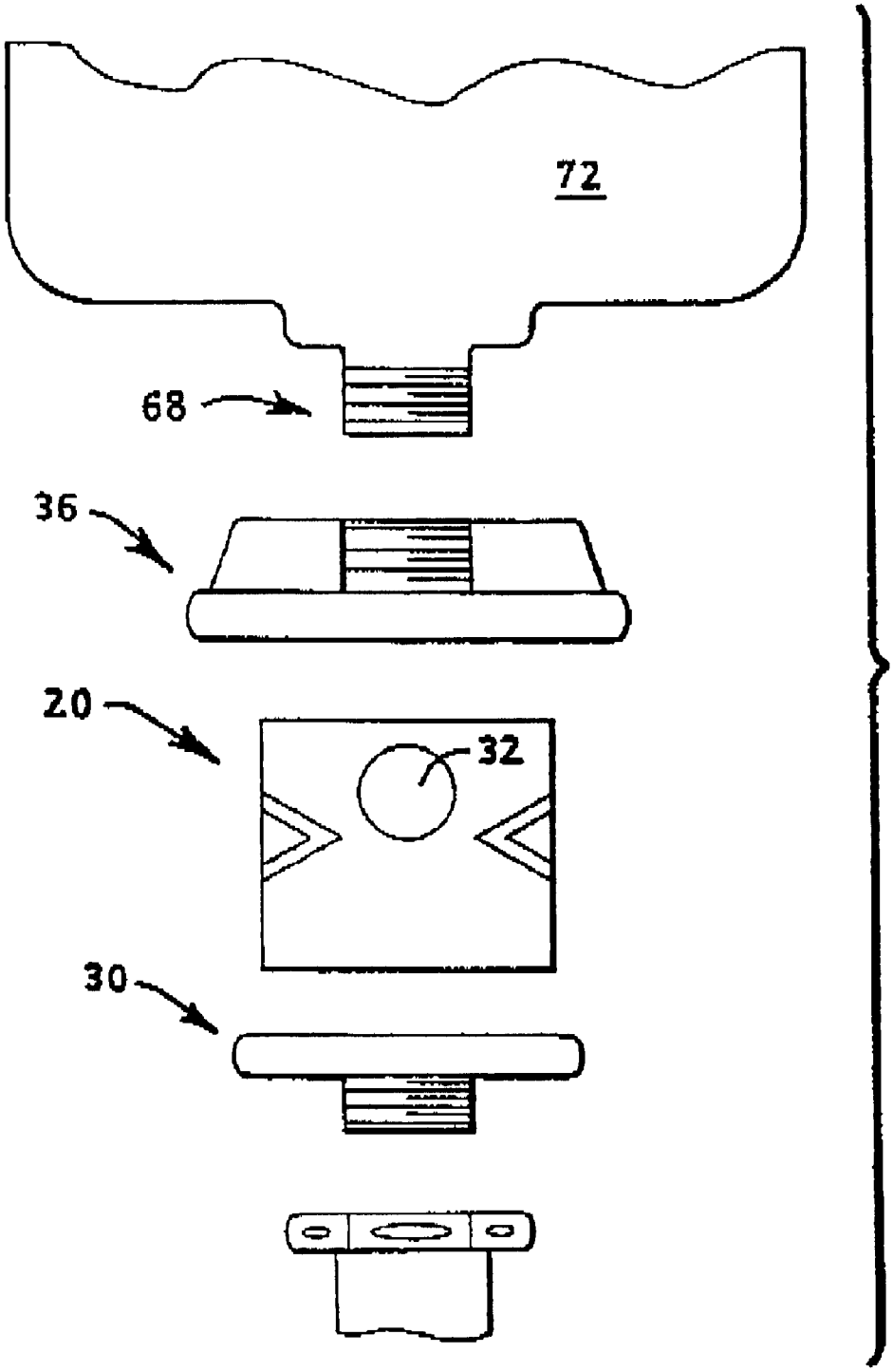
FIG. 7 depicts a side elevation view of the stop valve attached to a sink at one end, and a tail-piece at the other end.

The bottom of the lower assembly contains a 1 ½ in external pipe thread 56, which mates with a nut covering the tail piece of the P-Trap 73, as shown in FIG. 7, thus providing an outlet to allow the waste water to exit to the waste stack. The inside of the lower assembly contains a valve seat 34, which provides a watertight seal of the stop ball and the lower assembly in one of the alternative embodiments. Sealing of both the upper and lower assemblies to the body is accomplished by means of a flexible O-rings 28, 36.

A upper assembly 30 contains 1-½-inch internal pipe threads 26 about an opening providing an inlet for the waste water to flow out of the sink. This upper assembly forms a water-tight top of the stop valve. This upper assembly also contains projecting ears 54, similar to those contained by the bottom assembly. The top part of the body 20 also contains slots 52 which mate with the ears of the upper assembly, to seal the unit at the top. The ears of the upper assembly are first inserted into the slots, and the upper assembly then given a twist of about 15 degrees. The profile of the slots are such that this twisting motion causes the upper assembly to be progressively pressed against the body of the stop valve, in the same manner as is common with other accessories, such as garbage grinders which attach to the bottom of a sink in a similar manner. The O-rings 28 and 36 seal the unit when the top and bottom assemblies are thus attached.

Figure 5A:
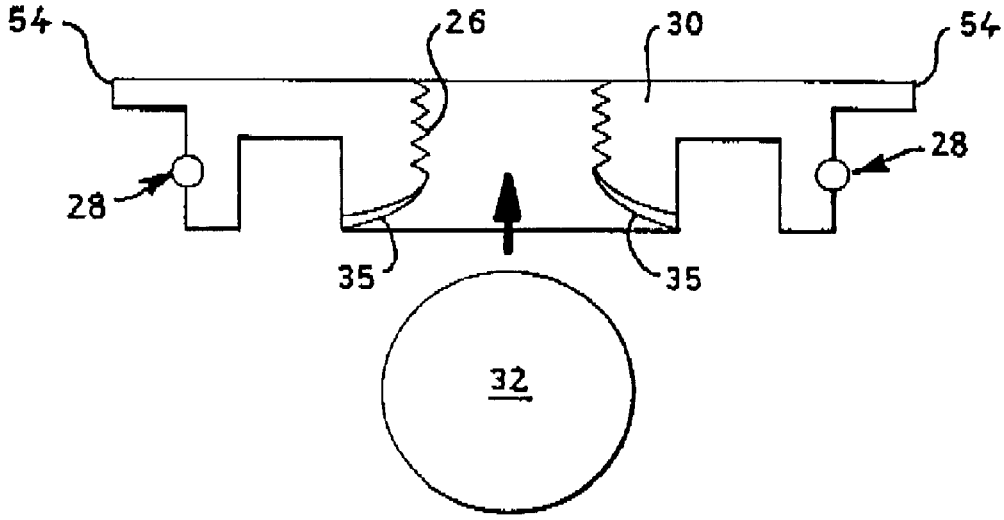
FIG. 5A depicts a cross section view of the upper assembly, with internal threads, and a seal at the bottom thereof.

The upper assembly also contains a valve seat, which may be seen in detail in FIG. 5A. In this figure, which shows the upper assembly in cross-section, the internal threads 26 are formed within the body of the assembly 30. At the lower end of these threads a seat 35 is formed, with a diameter slightly smaller than that of the stop ball 32, so that the stop ball, when pushed against the seat by the flow of the water from the waste stack, creates a water-tight seal, preventing the waste water from backing up into the inlet.

Figure 5B:
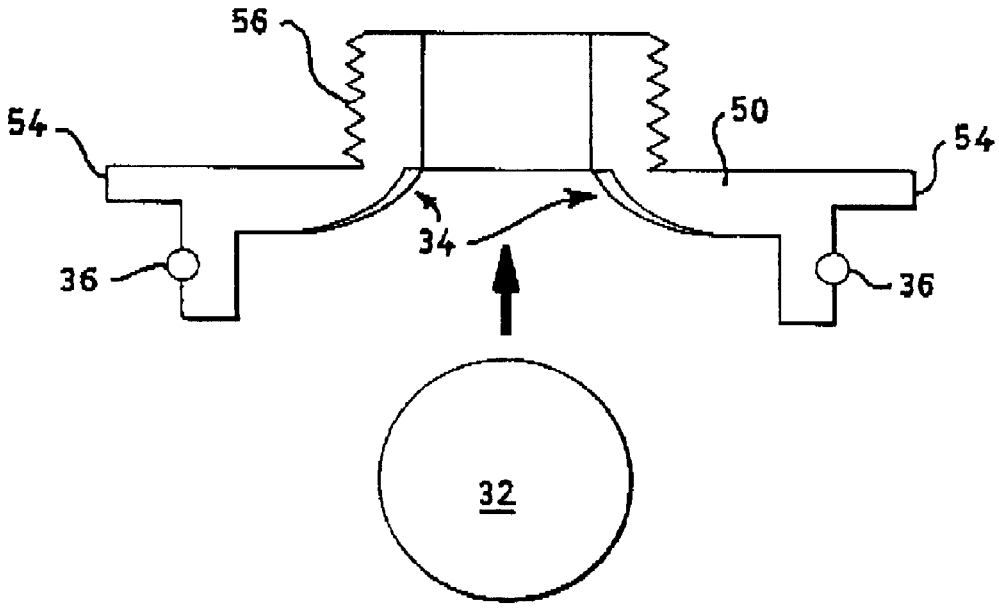
FIG. 5B depicts a cross section view of the lower assembly, with external threads, and a seal at the bottom thereof.

FIG. 5B shows how the seat is formed in the lower assembly, containing the external threads 56. In the case of the lower assembly, the seat 34 is formed at the lower end of the assembly, which is within the body of the valve when assembled.

FIGS. 5A and 5B also show the O-rings, 28 and 36, which sit within grooves formed in the upper and lower assemblies.

Referring now to FIG. 3, the entire assembly is connected to the sink strainer 68 of the sink 72 to which it is attached by means of the internal threads 26 of the upper assembly, which matingly engage with the external threads of the sink strainer.

When no water is flowing through the stop valve the stop ball 32 is prevented from descending to the lower seal 34 by the restraint arms 58, which restrain the stop ball at a level about half-way up the valve body, as seen in FIG. 3. It has been found that at least three of these restraint arms must be used to provide a stable mid-position for the stop ball. This ball is a light-weight hollow structure, similar to a Ping-Pong ball, which may be used as a stop ball in one of the embodiments of the current invention.

Figure 4A:
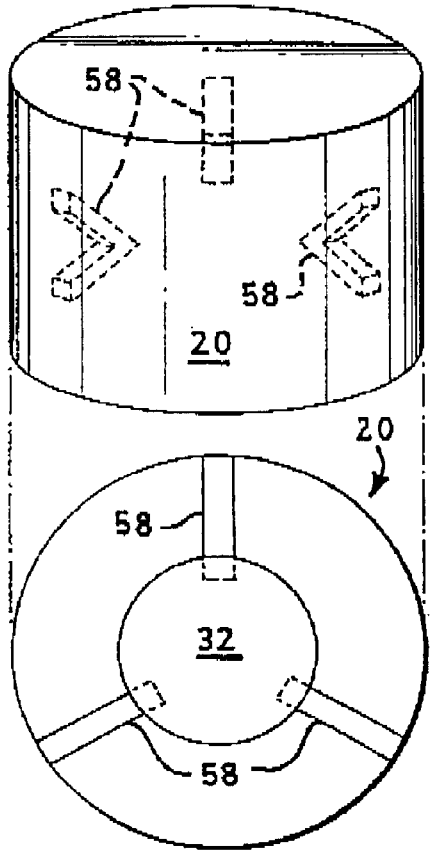
FIG. 4*a* depicts a top plan view of the restraint arms used to support the stop ball in the absence of water in the valve.

FIGS. 4A (perspective view) and 4C (top plan view) show further detail of the restraint arms. These arms 58 are each formed in a "V" shape, and are disposed at about 120 degrees from each other about the inner circumference of the valve body 20. The opening between the arms is seen to be somewhat smaller than the stop ball 32, as shown in FIG. 4C. The arms are symmetrically positioned halfway up the body, so that the body may be "flipped" vertically, and the position of the arms will not change relative to the top or bottom of the body.

When waste water flows from the sink downward through the stop valve, the water flows around the stop ball, as the valve body measures at least one inch in diameter larger than the radius of the stop ball, which itself is slightly larger that the 1-½-inch seals formed in the upper and lower assemblies.

When water attempts to flow upward, toward the sink from the tail piece of the P-trap, the stop ball is floated upward into the upper valve seat 24, effectively preventing the flow of water from backing up into the sink.

Figure 4B:
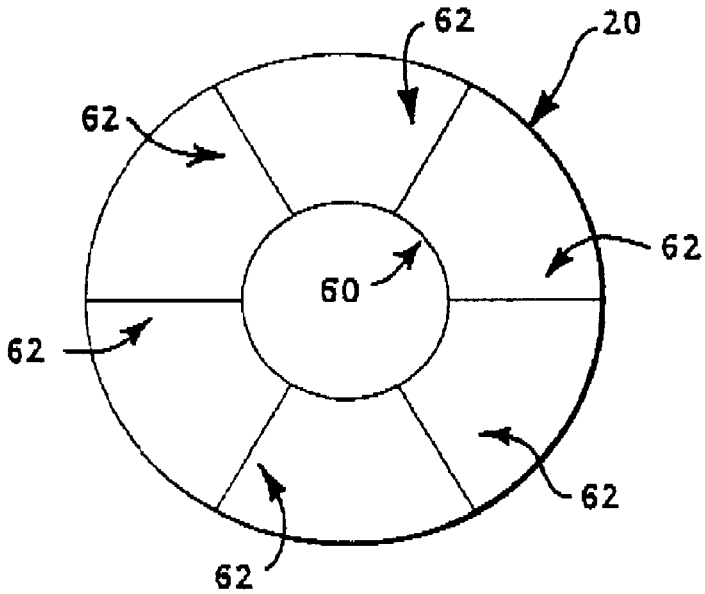
FIG. 4*b* depicts a top plan view of the restraint ring used to support the stop ball in the absence of water in the valve.

In another embodiment of the invention the restraint arms 58, are replaced by a restraint ring 60, which is supported by restraint ring supports 62, which are attached at one end to the restraint ring, and at the other end to the body 20, as shown in top plan view in FIG. 4B. The restraint ring and ring supports may be made of metal, or metallic wire, or of plastic.

FIG. 2 shows an additional inlet port 21, which is used in one of the embodiments of this invention for connection to a dishwasher exhaust hose, in the case that a dishwasher connection must be made. Dishwasher waste water enters the port below the level of the stop ball, so that it may flow downward into the P-trap, but not upward into the sink.

Figure 6:
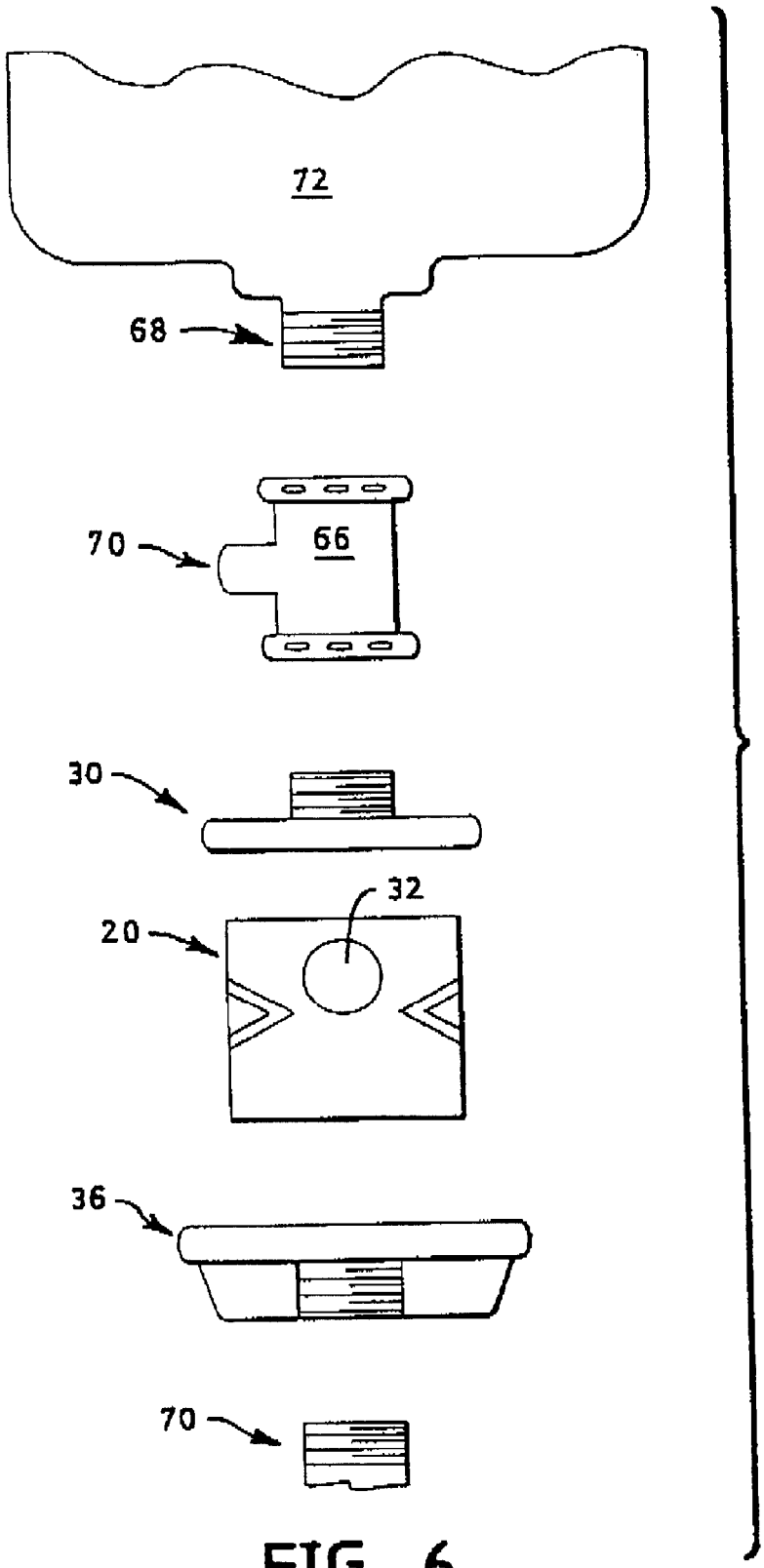
FIG. 6 depicts an embodiment of the invention adapted for use to accept waste water from a dishwasher, using a T-fitting between the sink strainer and the stop valve.

In still another embodiment of the invention, as shown in FIG. 6, the stop valve is adapted for use with a dishwasher by incorporating an additional fitting between the sink strainer and the stop valve. The waste water from the dishwasher in directed by a hose (not shown) from the dishwasher into entry port 78 of the dishwasher T-assembly 66. The T-assembly contains a female thread, which mates with the 1-½-inch external thread of the sink strainer 68. At its lower end, the T-assembly mates with the male thread of the upper assembly, while the lower assembly mates with the male threads 70 of the top of the P-trap. It should be noted that in this embodiment the upper and lower assemblies of the previous embodiments are reversed, with the upper assembly of the previous embodiments serving as the lower assembly of the current embodiment, and vice-versa.

It is further noted that in the embodiment of FIG. 6 the dishwasher waste water may back up into the sink, but will then flow back out when the dishwasher cycle changes. Another apparent embodiment locates the "T" fitting beneath the stop valve, so that waste water from the dishwasher may be prevented from flowing up into the sink. However, in such an embodiment, a stopped-up waste stack may overflow into the dishwasher, with the same effect as when overflowing into the sink.

To prevent the overflow of the waste stack into the dishwasher, the embodiment shown in FIG. 2 may be changed by "flipping" the stop valve body so that the port 21 is above the level of the stop ball while at rest. The symmetrical nature of the components in this invention permit the upper and lower assemblies to be interchanged, and the valve body to be rotated 180 degrees about a horizontal axis, as required.

While the invention has been described with reference to specific embodiments, it will be apparent that improvements and modifications may be made within the purview of the invention without departing from the scope of the invention defined in the appended claims.

What is claimed is:

1. A plumbing stop valve inserted between a plumbing fixture and a waste stack, the valve comprising:

(a) a substantially cylindrical body having an upper portion and a lower portion;

(b) a lower assembly further comprising two or more ears, a lower seat, and a water outlet;

(c) an upper assembly further comprising two or more ears, an upper seat and a water inlet;

(d) a stop ball within the body, and having a diameter larger than that of the upper seat;

(e) means to restrain the stop ball from descending onto the lower seat in the absence of water flow;

(f) an upper O-ring affixed to the upper assembly; and (g) a lower O-ring affixed to the lower assembly, wherein the upper assembly and lower assembly are removeably attached to the body by engaging said ears with slots on the upper and lower portions of the body, and the O-rings providing water-tight seals, so that when water flows into the outlet, the stop ball is pressed against the upper seat, preventing the water from backing up into the valve.

2. The stop valve of claim 1, wherein the water inlet of the upper assembly and the water outlet of the lower assemblies are threaded.

3. The stop valve of claim 2, wherein the upper assembly further comprises internal threads, and wherein the lower assembly further comprises external threads.

4. The stop valve of claim 3, wherein the body is symmetrical, and wherein the locations of the upper and lower assemblies may be reversed in their position relative to the body.

5. The stop valve of claim 4, further comprising a T-adapter, comprising an upper end and a lower end, matingly attached at the upper end to a strainer thread of a sink, and at the lower end to the threads of the upper assembly, the T-adapter further comprising a port for the attachment of an exhaust water exhaust hose from a dishwasher.

6. The stop valve of claim 5, further comprising a port located in the valve body, and below the stop-ball retaining means, into which the exhaust water of a dishwasher may be conducted by the dishwasher exhaust hose, so that said dishwasher exhaust water cannot back up into the inlet.

7. The stop valve of claim 6, wherein the means to restrain the stop ball further comprises three or more restraint arms.

8. The stop valve of claim 6, wherein the means to restraint the stop ball further comprises a restraint ring suspended in the center of the body.

9. The stop valve of claim 1, wherein the means to restrain the ball further comprises three or more restraint arms.

10. The stop valve of claim 9, wherein the body, the upper assembly, and the lower assembly are all made of plastic, and wherein the body and the restraint arms are integrally formed by molding.

11. The stop valve of claim 1, wherein the means to restrain the ball further comprises a restraint ring suspended in the center of the body.

12. The stop valve of claim 11, wherein the body, the upper assembly, and the lower assembly are all made of plastic.

13. The stop valve of claim 10, wherein the stop valve further comprises a Ping-Pong ball.

14. The stop valve of claim 12, wherein the stop valve further comprises a Ping-Pong ball.

* * * * *